US006461177B1

(12) United States Patent
Saka et al.

(10) Patent No.: US 6,461,177 B1
(45) Date of Patent: Oct. 8, 2002

(54) ELECTRICAL CONNECTOR

(75) Inventors: Yukinori Saka; Masamitsu Chishima, both of Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/569,869

(22) Filed: May 12, 2000

(30) Foreign Application Priority Data

May 18, 1999 (JP) ..... 11-137699

(51) Int. Cl.[7] ..... H01R 13/62; H01R 13/64; H01R 13/514

(52) U.S. Cl. ..... 439/157; 439/372; 439/681; 439/752

(58) Field of Search ..... 439/157, 372, 439/152, 153, 154, 155, 156, 158, 160, 310, 681, 752

(56) References Cited

U.S. PATENT DOCUMENTS 4,772,229 A 9/1988 Nix et al.
5,445,530 A * 8/1995 Inoue et al. ..... 439/157
5,509,816 A * 4/1996 Katsuma ..... 439/157
5,672,067 A * 9/1997 Ryll et al. ..... 439/157
5,681,175 A * 10/1997 Busse et al. ..... 439/157
5,725,398 A * 3/1998 Cappe ..... 439/752
5,873,745 A * 2/1999 Duclos et al. ..... 439/157
5,938,458 A * 8/1999 Krehbiel et al. ..... 439/157
5,989,044 A * 11/1999 Miyamoto ..... 439/157
6,012,933 A * 1/2000 Katsuma ..... 439/157
6,019,618 A * 2/2000 Nakata ..... 439/157
6,019,620 A * 2/2000 Kodama et al. ..... 439/157

FOREIGN PATENT DOCUMENTS

DE 93 14 625 12/1993

* cited by examiner

*Primary Examiner*—P. Austin Bradley
*Assistant Examiner*—Edwin A. León
(74) *Attorney, Agent, or Firm*—Banner & Witcoff, Ltd.

(57) ABSTRACT

When a connector housing 20 and an equipment connector 10 are correctly joined, a regulating groove 24D of a retainer 24 of the housing 20 fits with a rib 16 of the equipment connector 10, thereby allowing the two housings 10 and 20 to be fitted together. The position of groove 24D may be varied to suit different positions of rib 16, thereby permitting a common connector housing to be made suitable for a specific equipment connector having an appropriate rib. The shape of the retainer 24 is simpler than the shape of the housing main body 21. Consequently, the cost of the mould for the retainer 24 is lower.

11 Claims, 6 Drawing Sheets

ELECTRICAL CONNECTOR

TECHNICAL FIELD

The present invention relates to an electrical connector provided with an incorrect-fitting detecting function.

BACKGROUND TO THE INVENTION

Conventional connectors provided with an incorrect fitting-detecting function include the one described in U.S. Pat. No. 4,772,229. This connector comprises a male housing and a female housing capable of mutually fitting together, ribs which extend in a fitting direction being formed on an inner circumference of a recess of the male housing, and grooves formed on an outer circumference of the female housing fitting with these ribs. The ribs and grooves are provided at positions which differ according to each connection position, thereby preventing incorrect connection of otherwise similar connectors. If the male and female housings are incorrectly fitted together, the ribs do not correspond with the grooves, and consequently strike against anterior end circumference edges of the female housing, thereby preventing fitting.

In the case of conventional connectors, a plurality of cavities or the like are provided in the housing in order to allow terminal fittings to be inserted therein. Consequently, the shape thereof is complex, and an expensive mould is required to produce the plastic components for this complex shape.

In the conventional connector, the ribs and grooves for detecting incorrect fitting are formed directly on the housing. Consequently, a plurality of different housings must be provided, these having the ribs and grooves in differing locations. That is, there is the additional problem that a plurality of expensive moulds are required when the housings are manufactured. Consequently, production costs increase.

The present invention takes the above problem into consideration, and aims to present a connector wherein the production costs are reduced.

SUMMARY OF THE INVENTION

According to the invention there is provided an electrical connector comprising mutually engageable connector housings, one of the housings having a projection and the other of said housings having a recess engageable with said projection to ensure correct matching of said housings, characterised in that one of said projection and recess is provided on a component attachable to the respective housing.

Such a connector permits a common and somewhat complex connector housing to be made unique by the attachment of one of a number of relatively inexpensive components each having unique position for the projection/recess.

The attachable component may also comprise a retainer for electrical terminals, and be movable from a temporary position, in which terminals are insertable, to a final position in which terminals are latched. The temporary position preferably prevents full engagement of the housings. The component may be slidable within a slot of the respective housing.

Preferably the projection/recess is a rib/groove combination, extending in the fitting direction of the connector housings. Such a rib/groove can be relatively easily formed.

BRIEF DESCRIPTION OF DRAWINGS

Other features of the invention will be apparent from the following description of a preferred embodiment shown by way of example only the accompanying drawings in which.

DESCRIPTION OF PREFERRED EMBODIMENT

Figure 1:
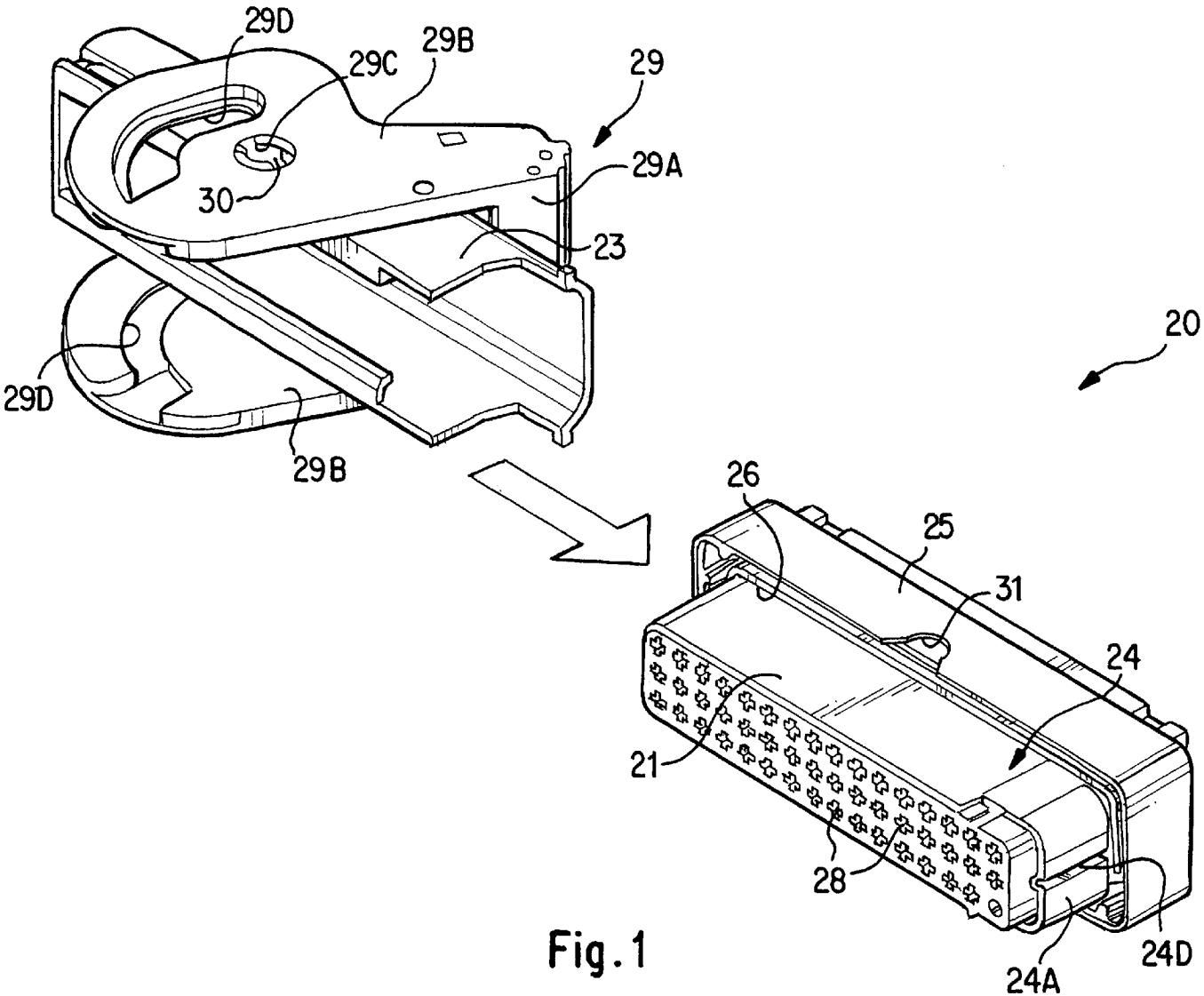
FIG. 1 is a diagonal view of an embodiment of the present invention showing a female housing and an electric wire cover in a separated state.
Figure 2:
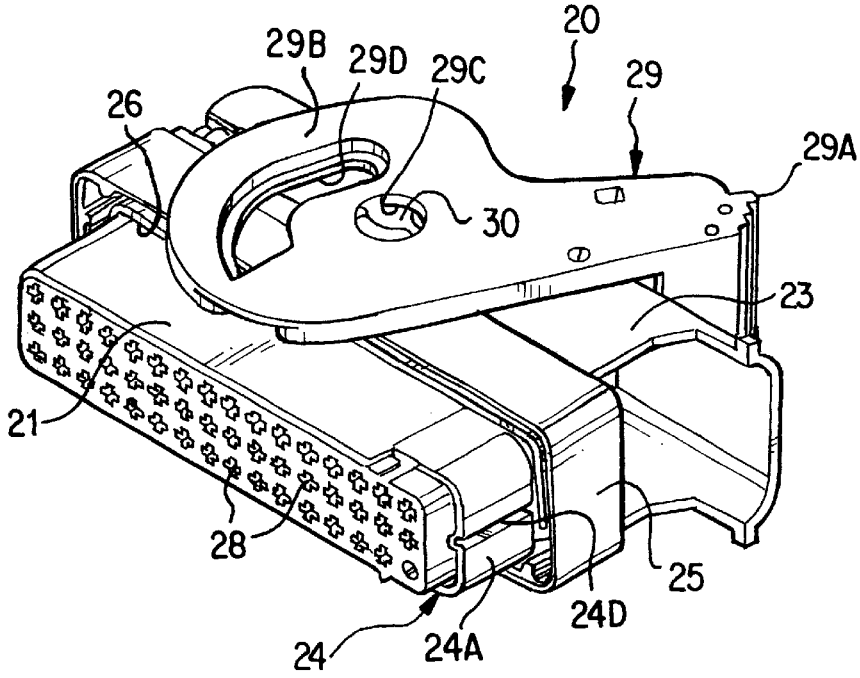
FIG. 2 is a diagonal view showing the electric wire cover attached to the female housing.
Figure 3:
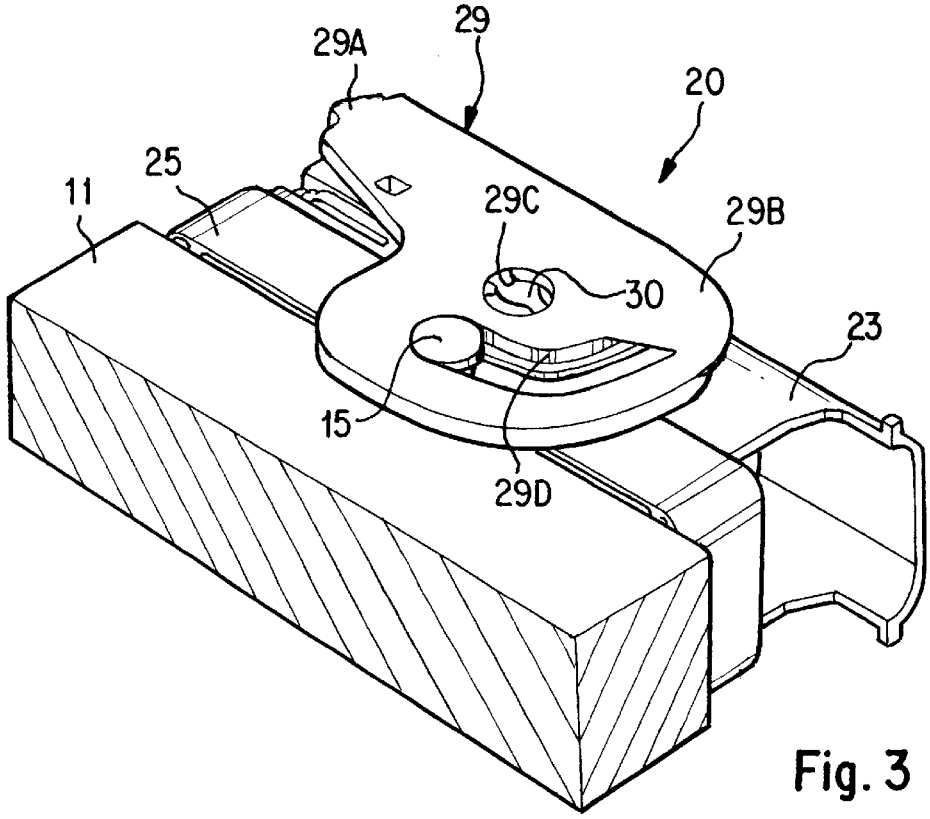
FIG. 3 is a partially cut-away diagonal view showing the female housing in a fitted state with an equipment housing.
Figure 4:
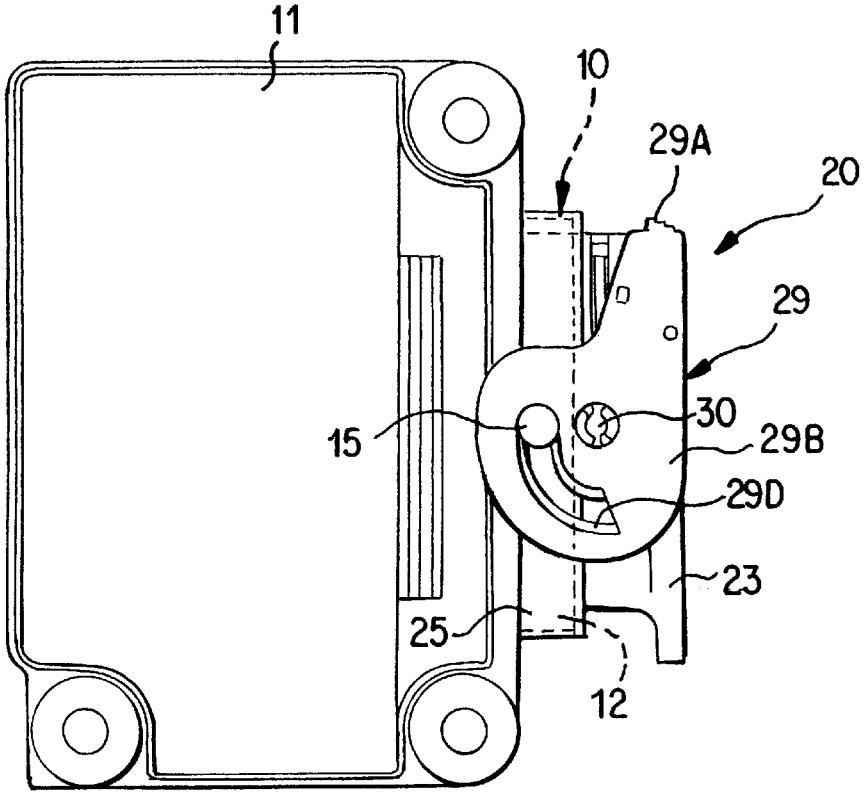
FIG. 4 is a plan view showing the female housing in the fitted state with the equipment housing.
Figure 5:
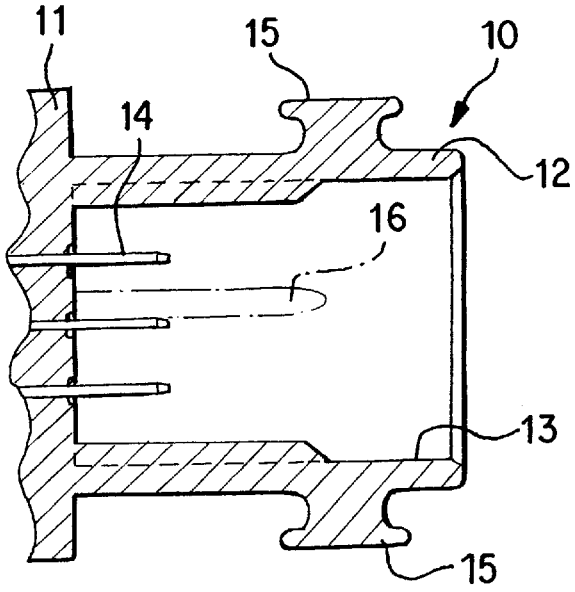
FIG. 5 is a vertical part cross-sectional view of the equipment housing.
Figure 6:
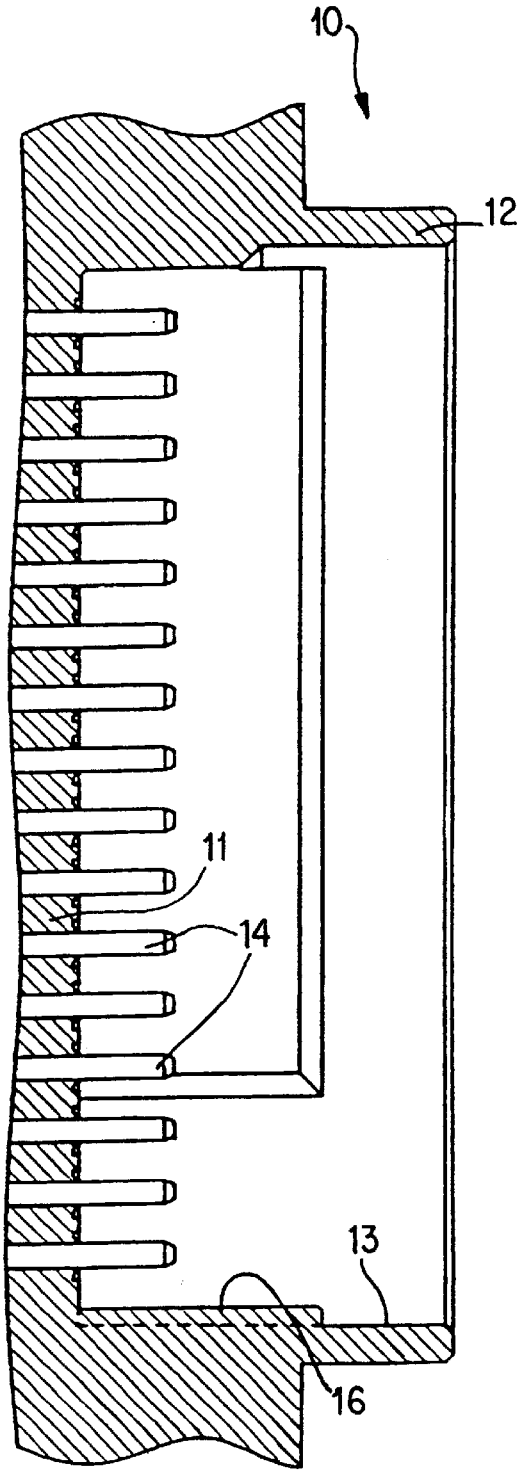
FIG. 6 is a horizontal part cross-sectional view of the equipment housing.
Figure 7:
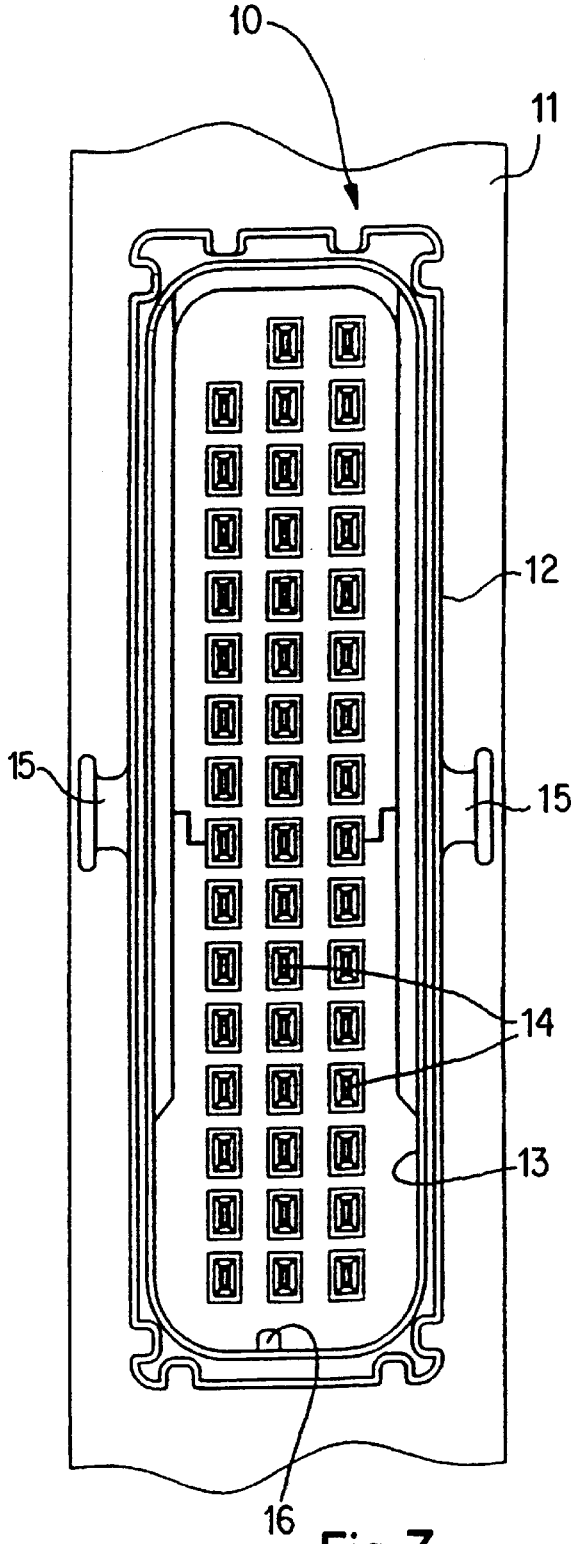
FIG. 7 is front view of the equipment housing.

An embodiment of the present invention is described below with the aid of FIGS. 1 to 11. A connector of the present embodiment is provided with female housing 20 and an equipment housing 10, these being capable of mutually fitting together and being separated.

The equipment housing 10 is provided on an outer face of an equipment main body 11, an outer wall portion of this equipment main body 11 being indented, and an angular tubular shaped hood 12 protruding outwards from circumference edges of this indented portion. A housing main body 21 of the female housing 20 fits within a fitting recess 13 which is composed of the indented portion and the hood 12. The equipment housing 10 has margin spaces (not shown) for ensuring the formation of the fitting recess 13 which is to be formed in the side of the equipment main body 11. The fitting recess 13 extends into the interior of the equipment main body 11. As a result, the hood 12 protrudes only a short distance from the outer face of the equipment main body 11. Tips of a plurality of male terminal fittings 14, which have passed through the wall portion, face into the recess 13 of the equipment housing 10. When the female housing 20 is fitted with the recess 13, these male terminal fittings 14 make contact with female terminal fittings 22.

The female housing 20 comprises a housing main body 21 into which the female terminal fittings 22 (shown in FIG. 8 and 9) are inserted, an electric wire cover 23 attached to the housing main body 21, and a retainer 24 attached to the housing main body 21 to indicate incorrect fitting. A tubular fitting member 25 surrounds an outer circumference of the housing main body 21. This tubular fitting member 25 extends in an anterior direction from a posterior end of the housing main body 21. However, the length of the tubular fitting member 25 is such that the extending end thereof reaches a location behind an anterior end face of the housing main body 21. Consequently, approximately half of the anterior side of the housing main body 21 is exposed. When the two housings 10 and 20 are fitted together, the tubular fitting member 25 fits with an outer circumference of the hood 12 of the equipment housing 10. Furthermore, the portion of the outer circumference of the housing main body 21 surrounded by the tubular fitting member 25 has a ring-shaped sealing member 26 attached thereto. This sealing member 26 seals the space between an inner circumference face of the hood 12 of the equipment housing 10 and the outer circumference of the housing main body 21.

Figure 8:
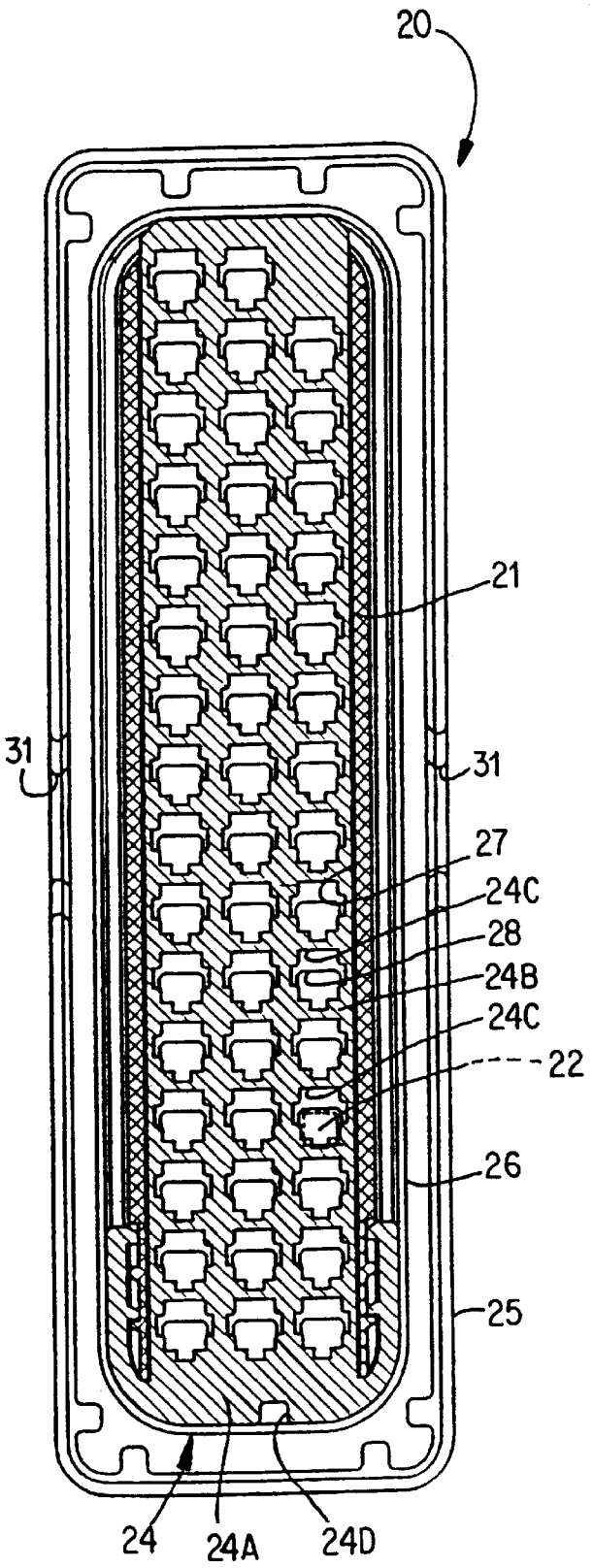
FIG. 8 is a cross-sectional view showing a retainer in a fully engaged state on the female housing.
Figure 9:
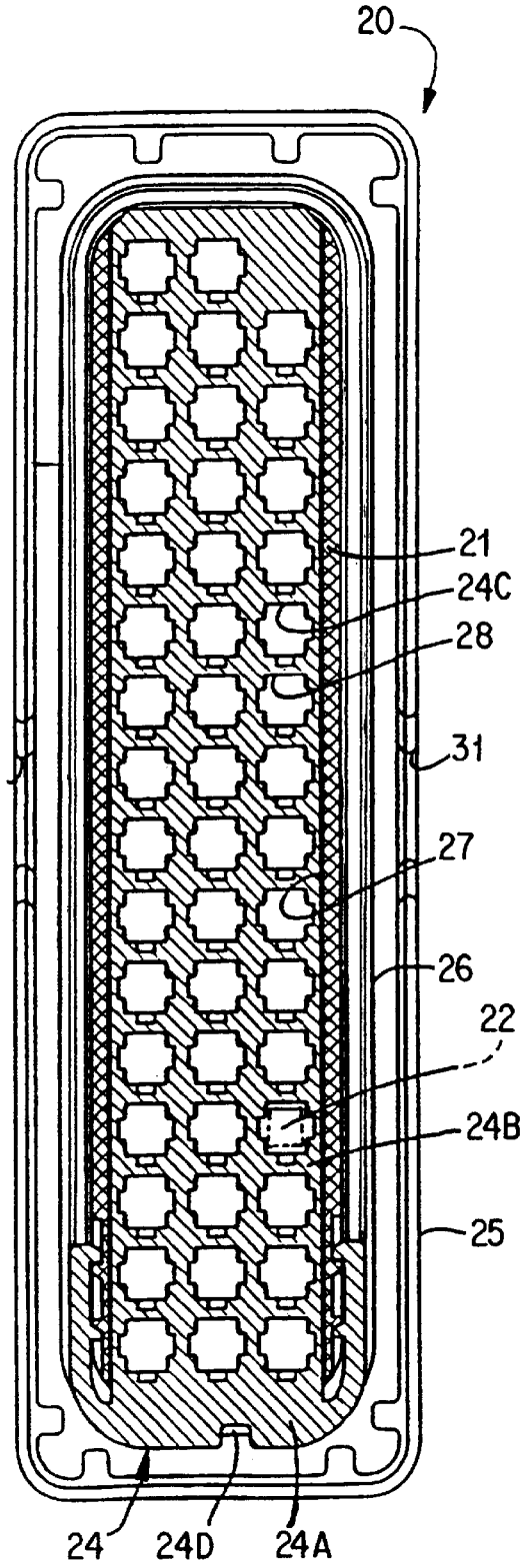
FIG. 9 is a cross-sectional view showing the retainer in a temporarily stopped state on the female housing.

The retainer 24 is attached from the side (from a direction at right angles to a direction of fitting of the two housings 10 and 20) to the protruding portion of the housing main body 21 (to the anterior of the sealing member 26). The retainer 24 comprises a U-shaped attachment member 24A and a plate-like stopping member 24B which extends from the attachment member 24A. The retainer 24 is attached by inserting the stopping member 24B into a retainer attachment hole 27 in the housing main body 21. As shown in FIG. 9, when the retainer 24 is in a temporarily stopped state, through holes 24C of the retainer 24 fit with terminal housing members 28 of the housing main body 21, thereby allowing the female terminal fittings 22 to be inserted into the terminal housing member 28. When the retainer 24 is moved into a fully stopped state, as shown in FIG. 8, hole edges of the through holes 24C move into the terminal housing members 28 and engage with the female terminal fittings 22. By this means, the female terminal fittings 22 are prevented from moving in a direction of removal.

Furthermore, when the retainer 24 is in the temporarily stopped state, the attachment member 24A thereof protrudes to an exterior face of the housing main body 21. Consequently, the attachment member 24A interferes with the hood 12 of the equipment housing 10 if an attempt is made to fit the two housings 10 and 20 together. Fitting is thereby prevented. That is, an abnormality in the attaching state of the retainer 24 allows one to detect whether the fitting operation of the two housings 10 and 20 is correct.

The electric wire cover 23 guides electric wires (not shown), attached by crimping to the female terminal fittings 22, in a specified direction from a rear face of the housing main body 21. A lever 29 is attached to side faces of the electric wire cover 23. The lever 29 has an operating member 29A and a pair of arms 29B which extend from both sides of the operating member 29A. Supporting axes 30 of the electric wire cover 23 fit into axis receiving holes 29C formed in the arms 29B, thereby supporting the lever 29 in a pivotable state. Cam grooves 29D are formed in the arms 29B, these cam grooves 29D fitting with cam pins 15 formed on outer faces of the hood 12 of the equipment housing 10. The fitting or separating operation of the two housings 10 and 20 can be performed easily and with little operating force by pivoting the lever 29 when the cam pins 15 are in a fitted state within the cam grooves 29D. Moreover, the tubular fitting member 25 is provided with recessed grooves 31 to prevent the tubular fitting member 25 from interfering with the cam pins 15.

The shape of the housing main body 21 and the number of terminals of the female housing 20 which is fitted with the equipment housing 10 are standardised with respect to other equipment housings (not shown) and other female housings 20 fitting with other male housings (not shown). For this reason, a means is provided to prevent fitting from occurring when components have been incorrectly assembled. That is a rib 16 (an incorrect-fitting preventing means of the present invention) is formed within an inner circumference of the fitting groove member 13 of the equipment housing 10, this rib 16 extending in a fitting direction of the two housings 10 and 20. The location of the rib 16 is such that it will fit with the incorrect-fitting preventing means of the female housing 20. An anterior end of the rib 16 is located behind the anterior end of the hood 12. Consequently, the rib 16 does not interfere with the supporting members when the two housings 10 and 20 are in a fitted state.

The retainer 24 for stopping the female terminal fittings 22 functions as an incorrect-fitting preventing means for the female housing 20. As described above, this retainer 24 is formed as a component separate from the housing main body 21. An outer face of the attachment member 24A of the retainer 24 has a regulating groove 24D which extends in the direction of fitting of the two housings 10 and 20. This regulating groove 24D is located so that it will fit with the rib 16 of the equipment housing 10.

The female housing 20 of the present embodiment has a standardised number of terminals and a standardised housing shape. However, the other female housings 20 that fit with other equipment housings 10 (not shown) or other male housings (not shown) each have their regulating groove 24D located in a position which differs from the location of the regulating groove 24D of the female housing 20 of the present embodiment.

Figure 10:
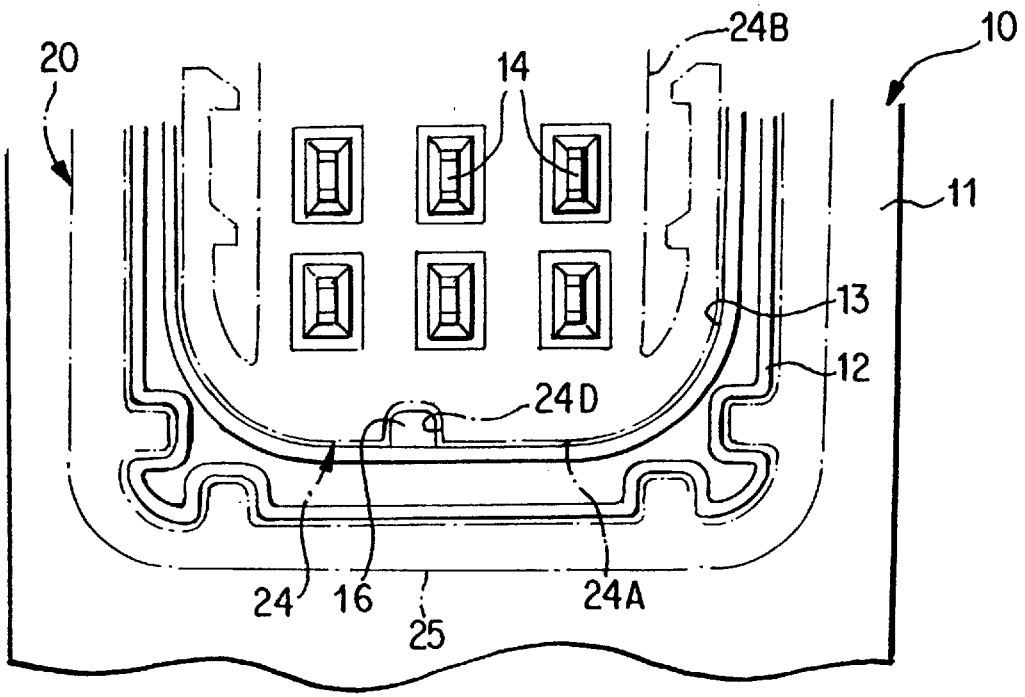
FIG. 10 is a partially cut-away front view showing the correctly assembled female housing in a fitted state with the equipment housing.
Figure 11:
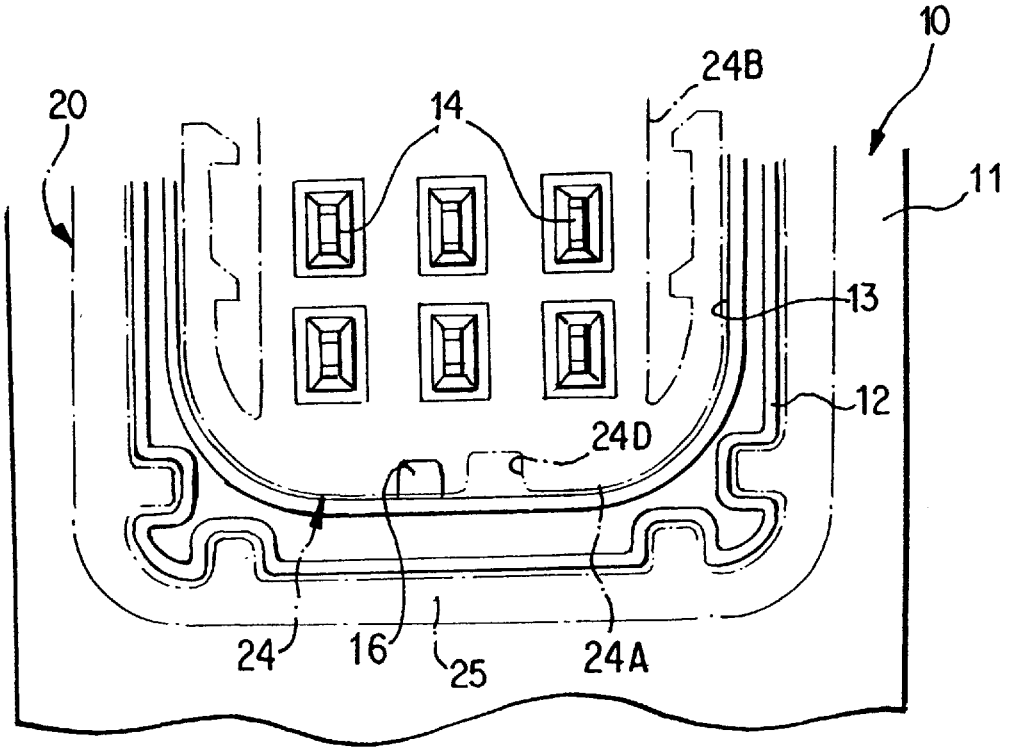
FIG. 11 is a front view showing the detection of the incorrectly assembled female housing which is in a fitted state with the equipment housing.

If the equipment housing 10 and the female housing 20 are correctly assembled and fitted together, the location of the rib 16 and the location of the regulating groove 24D coincide and, as shown in FIG. 10, these incorrect-fitting preventing means fit together, thereby allowing the fitting operation of the two housings 10 and 20 to occur. In contrast, if the equipment housing 10 of the present embodiment is incorrectly fitted with a different female housing 20, the location of the regulating groove 24D does not coincide with the location of the rib 16. Instead, as shown in FIG. 11, the regulating groove 24D is formed at a different location. Consequently, the rib 16 and the anterior end of the retainer 24 interfere and the fitting operation of the two housings 10 and 20 is halted. In this manner, it is possible to detect whether the fitting together of the two housings 10 and 20 is correct or incorrect.

In the present embodiment, the retainer 24, which is the incorrect-fitting preventing means of the female housing 20, is formed as a component separate from the housing main body 21. Consequently, even if a plurality of housings 10 and 20 are to be fitted together, the housing main bodies 21, the electric wire covers 23 and the levers 29 are all standardised components, and one mould can be used for their manufacture. As a result, compared to the case where differing complex-shaped moulds must be produced for housing main bodies 21 provided with terminal housing members 28, tubular fitting member 25 etc., the cost of the mould can be reduced. Although one requires a plurality of types of retainers 24 which have their regulating grooves 24D in differing locations according to the type of assembly required, the U-shaped attachment member 24A and the stopping member 24B provided with the through holes 24C of the retainer 24 have a comparatively simple shape. The cost of a mould for the retainer 24 is lower than the cost of a mould for the housing main body 21. Consequently, when the female housings 20 are manufactured with a plurality of differing regulating grooves 24D, the overall cost of moulds for the present embodiment can be reduced.

Further, the retainer 24, which is the incorrect-fitting preventing means of the female housing 20, also has the function of retaining the female terminal fittings 22.

Consequently, the number of components is reduced compared to the case where an incorrect-fitting preventing means of the female housing 20 and a retainer 24 are separate components.

Moreover, the equipment main body 11 has spaces so that the housing main body 21 of the female housing 20 can fit therewith. Consequently, the entirety of the equipment housing 10 has a shape whereby it fits into the inner side of the equipment main body 11. As a result, the protruding distance of the hood 12 which fits into the tubular fitting member 25 of the female housing 20 can be decreased. Moreover, the protruding length of the tubular fitting member 25 of the female housing 20 which fits with the exterior of the hood 12 is made to correspond with the protruding length of the hood 12, and is thereby also decreased.

The present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, the incorrect-fitting preventing means formed as a component separate to the housing main body has configuration appropriate only for a female housing. However, according to the present invention, an incorrect-fitting preventing means formed as a component separate to a housing main body may equally well have a configuration suitable for both a female housing and an equipment housing, or for only an equipment housing.

(2) In the embodiment described above, the incorrect-fitting preventing means also functions as a retainer. However, according to the present invention, the incorrect-fitting preventing means may be a component which does not also serve the function of retainer (for retaining the terminal fittings).

(3) In the embodiment described above, the retainer is attached to the housing main body in a direction which is at right angles with the direction of fitting of the housing main body. However, according to the present invention, the retainer may also be attached to the housing main body from an anterior direction.

(4) The present embodiment describes a water-proof connector. However, the present invention is also suitable for a connector which is not water-proof.

(5) The present embodiment describes a lever-type connector. However, the present invention is also suitable for connectors other than a lever-type connector.

What is claimed is:

1. An electrical connector comprising mutually engageable connector housings, one of the housings having a projection and the other of said housings having a recess that receives said projection only when the housings are oriented to properly fit together, wherein the housing with the recess contacts the projection to prevent fitting the housings together in an improper orientation to ensure correct matching of said housings, and wherein one of said projection and said recess is provided on a separable retainer for retaining terminals that is attached to the respective housing, said housings and retainer fitting together in only one orientation.

2. A connector according to claim 1 wherein said component is slidable within a slot of said respective housing.

3. A connector according to claim 1 wherein said retainer is planar.

4. A connector according to claim 3 wherein said retainer is movable from a temporary position in which terminals are insertable into a housing, and a final position in which said terminals are latched in the housing.

5. A connector according to claim 4 where, in said temporary position, said retainer prevents full engagement of said connector housings.

6. A connector according to claim 1 wherein said retainer is movable from a temporary position in which terminals are insertable into a housing, and a final position in which said terminals are latched in the housing.

7. A connector according to claim 6 where, in said temporary position, said retainer prevents full engagement of said connector housings.

8. A connector according to claim 1 wherein said projection comprises a rib of one of said housings and said recess comprises a mating groove of the other of said housings.

9. A connector according to claim 8 wherein said rib is provided within a hood of said one of said housings.

10. A connector according to claim 8 wherein said groove is provided on said component.

11. A connector according to claim 10 wherein said rib is provided within a hood of said one of said housings.

* * * * *